United States Patent [19]

Bollinger et al.

[11] Patent Number: 4,650,012

[45] Date of Patent: Mar. 17, 1987

[54] APPARATUS FOR CLEANING DRILLS

[75] Inventors: Karl Bollinger, Rueil Malmaison; Philippe Chagnot, Moret sur Loing, both of France

[73] Assignee: Soletanche, Nanterre, France

[21] Appl. No.: 729,265

[22] Filed: May 1, 1985

[30] Foreign Application Priority Data

May 3, 1984 [FR] France ..... 84 06887

[51] Int. Cl.[4] ..... E21B 12/06

[52] U.S. Cl. ..... 175/84; 15/104.04

[58] Field of Search ..... 175/84, 313, 394; 172/606, 610; 15/104.04; 198/498

[56] References Cited

U.S. PATENT DOCUMENTS

| | | | |
|---|---|---|---|
| 2,000,195 | 5/1935 | Siebel | 175/313 X |
| 3,581,833 | 6/1971 | Hennecke et al. | 175/84 |
| 4,533,000 | 8/1985 | van der Lely | 172/610 X |

FOREIGN PATENT DOCUMENTS

| | | | |
|---|---|---|---|
| 8204914 | 7/1984 | Netherlands | 175/313 |
| 908053 | 10/1962 | United Kingdom | 175/84 |
| 414366 | 7/1974 | U.S.S.R. | 175/84 |
| 0705099 | 12/1979 | U.S.S.R. | 175/84 |

*Primary Examiner*—Stephen J. Novosad
*Assistant Examiner*—David J. Bagnell
*Attorney, Agent, or Firm*—Thomas A. O'Rourke

[57] ABSTRACT

The invention relates to an apparatus for cleaning, during its extraction without rotation, of a drill formed from a helical surface wound around an axial stem. It comprises a scraper blade capable of being inserted at will between two turns of the helical drill, and that it comprises a motor for causing the scraper blade to revolve around the stem substantially in synchronism with the speed of extraction of the drill.

10 Claims, 2 Drawing Figures

APPARATUS FOR CLEANING DRILLS

Figure 1:
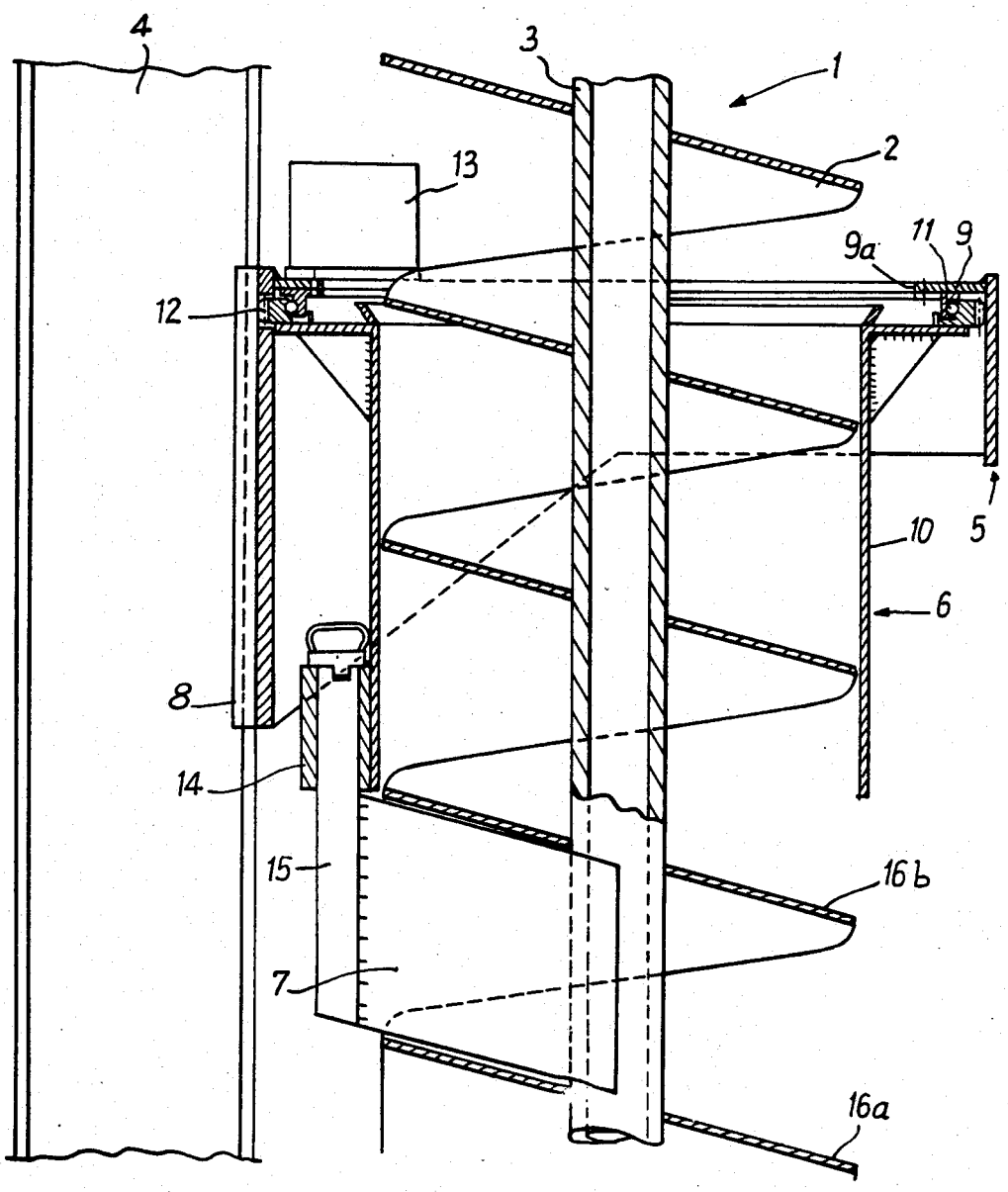

The present invention relates to apparatus allowing the cleaning, during its extraction from the ground, of a tool formed by a helical surface wound around a stem, or in particular a drill. It is known to form piles in the ground in a single operation using drills of a length equal to or greater than the depth of the pile to be formed.

The drill is "screwed" into the ground to the desired depth and then extracted. In order to avoid this extraction requiring too great an energy, drills are used which have a tubular axial stem. Through this stem, concrete under pressure is injected under the drill which has the effect of driving it progressively upwards. This operation thus has the advantage of simultaneously achieving the concreting of the pile, avoiding collapse of the side walls of the excavation during the extraction of the drill, and reducing the tractive force necessary.

Further it has been found that extraction of the drill must be effected without rotating the latter. In effect, all rotary movement favours infiltration of concrete between the drill and the side walls of the excavation, which creates defects in the pile to be formed. Further, rotation of the drill frequently results in the fall of clods of earth which mix with the concrete and thus create other defects.

During extraction of the drill without rotation, earth is lifted up between the turns where it frequently remains stuck, even after their emergence outside the excavation.

It is thus necessary to clean the drill during the course of its being extracted. This cleaning on the one hand has to be as rapid as possible in order to avoid slowing down extraction of the drill, and on the other hand has to be sufficiently efficacious so that no earth remains stuck to the turns to ultimately fall from on high from the drill.

Until the present this cleaning was most often realized with the help of shovels and picks operated by hand, which obviously did not permit achieving the two objectives of rapidity and efficacity.

The present invention aims to get around this disadvantage by assuring efficaciously and at a controlled speed the cleaning of the drill during the course of its extraction.

For this purpose the invention has as its object apparatus assuring the cleaning, during its extraction without rotation, of a drill formed from a helical surface wound around an axial stem, characterized by the fact that it comprises a scraper blade capable of being inserted between two turns of the helical surface and that it comprises means for revolving around the stem said scraper blade at the desired speed substantially in synchronism with the extraction of the drill.

During extraction of the drill, the scraper blade remains inserted between two turns of the helical surface which is swept by the revolving action of the scraper blade about the drill, while the drill itself remains stationary.

The speed of revolving of the scraper blade is governed in such a manner that it makes substantially one tour about the drill while this moves vertically by the amount of the pitch of the helical blade.

Advantageously said scraper blade can pivot between a first position where it is completely outside the exterior envelope of the drill to a second position where it is inserted between two turns of the helical blade.

This arrangement allows avoidance of having to revolve the scraper blade in the opposite sense during insertion of the drill.

In order to better ensure the efficacity of cleaning, the scraper blade can advantageously, when it is inserted between two turns of the helical blade and when it is sufficiently long for this, have its free end in abutment on the axial stem.

The scraper blade thus makes an angle i which is not zero with the plane passing through the axis of its support and the axis of the axial stem.

In this way the effort of unsticking earth by the scraper blade does not entail deformation of the latter, because of its being held firmly against the stem, nor does it necessitate a specially reinforced support.

In one particular mode of carrying out the invention the scraper blade is mounted on means revolving at the desired speed about the drill, said means being carried by a support capable of sliding up and down along a carrying post from which the drill is suspended.

This sliding of the support along the post allows absorption of any possible lack of synchronism between the speed of revolving of the scraper blade and the vertical speed of extraction of the drill, which would have the effect of causing either a rise or a descent of the scraper blade relative to its initial position.

The revolving means can for example be fast with a crown wheel coaxial with the drill and meshing with the output pinion of a motor mounted on the support.

Figure 2:
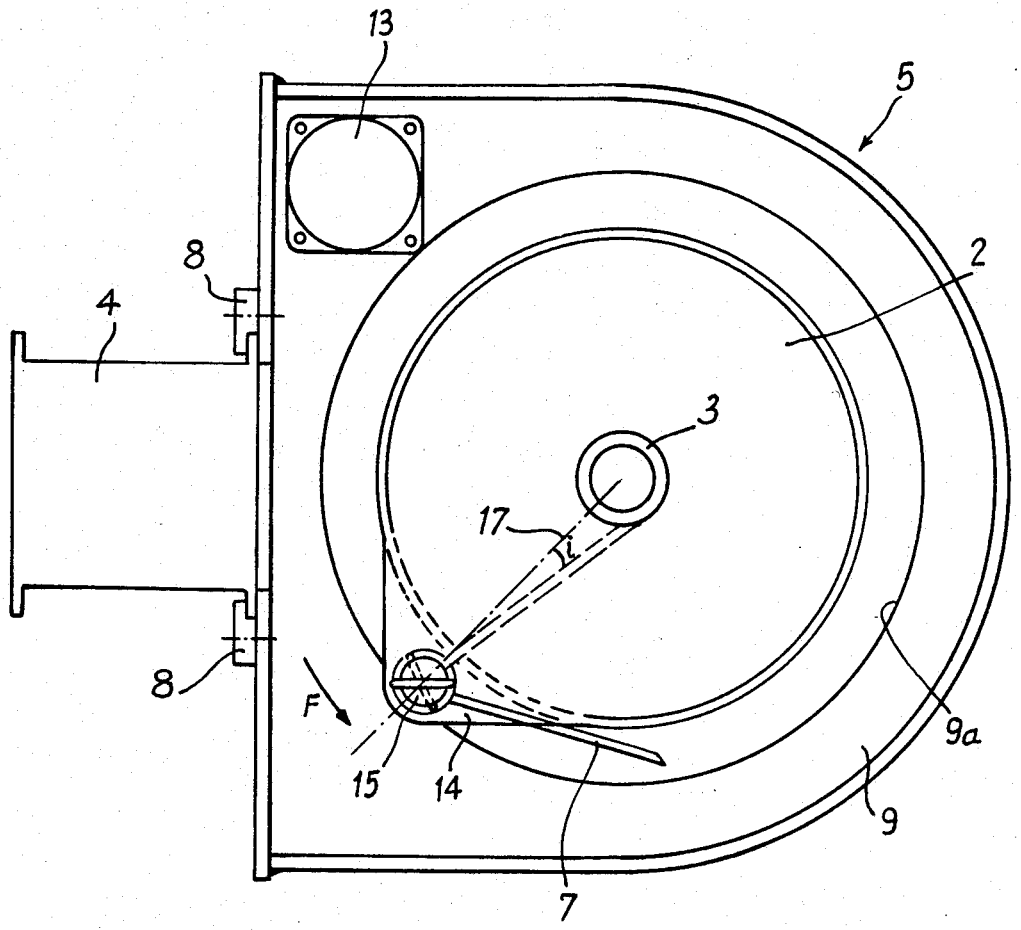

There will now be described by way of non-limiting example one particular way of carrying out the invention with reference to the schematic drawings attached, in which:

FIG. 1 is a view in axial section of a drill furnished with apparatus in accordance with the invention, and FIG. 2 is a view from above of this apparatus.

Drill 1 shown in the drawing comprises a helical surface 2 wound around a tubular stem 3.

Drill 1 is supported and given rotational motion by means of apparatus mounted slidingly on post 4 (not shown.)

The arrangement according to the invention essentially comprises a support 5 and revolving means 6 carrying the scraper blade 7. Scraper blade 7 has a height substantially equal to the pitch of the helical blade 2.

Support 5 comprises a carriage 8 allowing it to slide freely on post 4. It also has in its upper part a platform 9 serving for the support of the revolving means 6 and having an opening 9*a* through which the drill passes.

The revolving means 6 is made of a section of tube 10 suspended from platform 9 by means of ball bearings 11 and carrying on its upper portion an externally toothed crown wheel 12 capable of cooperating with the not illustrated output pinion wheel of a motor 13 mounted on platform 9.

Tube 10 has in its lower portion a carrying hinge 14 adapted to receive a mounting bar 15 fastened with blade 7.

Bar 15 may be mounted in hinge 14 in two different positions. In a first position the blade 7 is inactive, being situated entirely outside the cylindrical exterior envelope of the drill. This is the position which is shown in solid lines in FIG. 2.

The other position is the operational position illustrated in FIG. 1, as well as by dotted lines in FIG. 2, in which blade 7 is inserted between two turns 16*a* and 16*b* of the helical surface 2. In this postion, the free end of blade 7 can rest against the tubular stem 3. In this case the angle i that the blade makes with the plane passing through the axis of its support and the axis of the stem is not zero.

During insertion of the drill by screwing, scraper blade 7 is placed in its non-operative position shown in solid lines in FIG. 2.

Once the drill has reached its desired depth, the scraper blade is placed in its operative position shown in FIG. 1 and concrete under pressure is injected under the drill through the tubular stem 3.

The thrust engendered by the concrete causes the progressive ascent of the drill, which is not rotating. In order to avoid this ascent causing a simultaneous ascent of the scraper blade 7, the latter is given the necessary revolving movement by motor 13 in the direction of arrow F of FIG. 2. In order that the height of the blade remains substantially constant, its speed of revolving is such that the blade makes one tour round the tubular stem 3 while the drill ascends a height equal to the pitch of the helical blade 2.

As a result of this revolving, blade 7 sweeps the whole of the space between the turns of helical blade 2, because it makes one tour per turn. Blade 7 causes the detachment and fall of earth brought up by the drill. The angle of incidence i being greater than 0, the effort of detaching tends to force blade 7 against stem 3 if it is long enough for this, and simultaneously to improve both the efficacity of cleaning, and to prevent deformation of the blade while at the same time allowing lightening of the load on the carrying hinge 14 and the mounting bar 15.

One can thus see, that if for any reason the speed of extraction of the drill should be subject to slight variations, these are translated only into a corresponding rise or fall of the support 5 sliding on post 4. This assures that cleaning is adapted to the speed of extraction of the drill whatever this may be.

This cleaning is further completely effective because all the space corresponding to the interior envelope of the drill is progressively swept by the scraper blade 7.

Various variants and modifications can obviously be made to the preceding description without thereby being beyond the scope or spirit of the ivention.

We claim:

1. Apparatus for cleaning drills during extraction of said drill without rotation, comprising a drill formed from a multiple-turn helical surface wound around an axial tubular stem, a scraper blade between two turns of said helical surface and motor means for revolving said scraper blade around the tubular stem in synchronism with the extraction speed of the drill.

2. Apparatus according to claim 1, characterized by the fact that said scraper blade is movable between a first position where it is completely outside the exterior envelope of the drill to a second position where it is inserted between two turns of the helical blade.

3. Apparatus according to one of claims 1 or 2, characterized by the fact that, when the scraper blade is inserted between two turns of the helical blade, the scraper blade has a free end in abutment on the axial stem.

4. Apparatus according to one of claims 1 or 2, characterized by the fact that the scraper blade has a length such that it is not in abutment on the axial stem.

5. Apparatus according to claim 3, characterized by the fact that when the extremity of the blade is in abutment on the stem, the angle between the blade and the plane passing through the axis of its support and the axis of the axial stem is not zero.

6. Apparatus according to any one of claims 1 or 2, characterized by the fact that said scraper blade is mounted on means revolving about the drill.

7. Apparatus according to claim 6, characterized by the fact that the means is arranged for revolving at a speed controlled as necessary.

8. Apparatus according to claim 7 characterized by the fact that the revolving means is carried by a support capable of sliding vertically on a stationery carrying post relative to the drill.

9. Apparatus according to claim 6, characterized by the fact that said revolving means is fast with a crown wheel coaxial with the drill and meshing with the output pinion of said motor.

10. Apparatus according to claim 6, characterized by the fact that the scraper blade is mounted on said revolving means for pivoting from its first position to its latter position.

* * * * *